US007438057B2

(12) United States Patent
Scheurer et al.

(10) Patent No.: US 7,438,057 B2
(45) Date of Patent: Oct. 21, 2008

(54) FUEL INJECTION SYSTEM

(75) Inventors: Hans-Peter Scheurer, Marbach (DE); Timo Steinbach, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/659,356

(22) PCT Filed: Jun. 9, 2005

(86) PCT No.: PCT/EP2005/052663

§ 371 (c)(1),
(2), (4) Date: Feb. 5, 2007

(87) PCT Pub. No.: WO2006/013128

PCT Pub. Date: Feb. 9, 2006

(65) Prior Publication Data

US 2008/0029065 A1 Feb. 7, 2008

(30) Foreign Application Priority Data

Aug. 3, 2004 (DE) ..... 10 2004 037 557

(51) Int. Cl.
*F02M 37/00* (2006.01)
*F02M 37/10* (2006.01)

(52) U.S. Cl. ..... 123/514; 123/456

(58) Field of Classification Search ..... 123/456, 123/514, 506, 447, 468, 469, 457, 511, 198 D
See application file for complete search history.

(56) References Cited

U.S. PATENT DOCUMENTS

| | | | | |
|---|---|---|---|---|
| 5,404,855 | A | 4/1995 | Yen et al. | |
| 6,497,217 | B2 * | 12/2002 | Kojima | 123/456 |
| 6,792,918 | B1 * | 9/2004 | Halsall | 123/446 |
| 7,066,152 | B2 * | 6/2006 | Stroia et al. | 123/467 |
| 2003/0077184 | A1 | 4/2003 | Ishimoto | |
| 2004/0250795 | A1 * | 12/2004 | Stroia et al. | 123/447 |

FOREIGN PATENT DOCUMENTS

| | | | |
|---|---|---|---|
| DE | 103 32 484 | A1 | 2/2005 |
| EP | 1 275 842 | A1 | 1/2003 |

* cited by examiner

*Primary Examiner*—Mahmoud Gimie
(74) *Attorney, Agent, or Firm*—Ronald E. Greigg

(57) ABSTRACT

A common rail fuel injection system having a low-pressure region from which a high-pressure fuel pump acts on fuel with high pressure and delivers it to a high-pressure fuel accumulator from which fuel is supplied to injectors that inject the highly pressurized fuel into the combustion chamber of an internal combustion engine in which the high-pressure pump, the high-pressure fuel accumulator, and the injectors are associated with a high-pump, pressure region. In order to avoid undesirable delays in the starting of the internal combustion engine, a check valve device is connected between the low-pressure region and the high-pressure region so that when a negative pressure is generated in the high-pressure region, fuel flows from the low-pressure region into the high-pressure region.

17 Claims, 3 Drawing Sheets

FUEL INJECTION SYSTEM

CROSS-REFERENCE TO RELATED APPLICATION

This application is a 35 USC 371 application of PCT/EP 2005/052663 filed on Jun. 9, 2005.

BACKGROUND OF THE INVENTION

1. Field of the Invention

The invention relates to a fuel injection system, in particular a common rail system, having a low-pressure region from which a high-pressure fuel pump acts on fuel with high pressure and delivers it to a high-pressure fuel accumulator from which fuel is supplied to injectors that inject the highly pressurized fuel into the combustion chamber of an internal combustion engine in which the high-pressure pump, the high-pressure fuel accumulator, and the injectors are associated with a high-pressure region.

2. Prior Art

Conventional fuel injection systems can have design-based leaks. For example, the injectors can represent leak points. The leakage quantity can be compared to a temperature-induced contraction of the fuel volume contained in the system. In special fuel injection systems, undesirable delays occur in the starting of the internal combustion engine.

OBJECTS AND SUMMARY OF THE INVENTION

The object of the current invention is to create a fuel injection system, in particular a common rail system, having a low-pressure region from which a high-pressure fuel pump acts on fuel with high pressure and delivers it to a high-pressure fuel accumulator from which fuel is supplied to injectors that inject the highly pressurized fuel into the combustion chamber of an internal combustion engine in which the high-pressure pump, the high-pressure fuel accumulator, and the injectors are associated with a high-pressure region, by means of which it is possible to avoid undesirable delays in the starting of the internal combustion engine.

In a fuel injection system, in particular a common rail system, having a low-pressure region from which a high-pressure fuel pump acts on fuel with high pressure and delivers it to a high-pressure fuel accumulator from which fuel is supplied to injectors that inject the highly pressurized fuel into the combustion chamber of an internal combustion engine in which the high-pressure pump, the high-pressure fuel accumulator, and the injectors are associated with a high-pressure region, the object is attained by virtue of the fact that a check valve device is connected between the low-pressure region and the high-pressure region so that when a negative pressure is generated in the high-pressure region, fuel flows from the low-pressure region into the high-pressure region. In special fuel injection systems, injectors are used that are designed so that no leakage occurs. As a result, the fuel injection system is absolutely fluid-tight when the engine is not running.

If there is a large temperature difference between when the engine is switched off and when it is restarted, then the fluid-tightness of the high-pressure region and the temperature-induced contraction of the fuel volume contained therein causes the air dissolved in the fuel to outgas. When starting, the outgassed air can cause the above-mentioned starting delay to occur. The check valve device according to the present invention produces a definite connection between the high-pressure region and the low-pressure region that can serve to eliminate any negative pressure that may build up in the high-pressure region.

In a preferred exemplary embodiment of the fuel injection system, the check valve device has a high-pressure inlet, a high-pressure outlet, and a low-pressure connection. By being provided with two high-pressure connections and one low-pressure connection, the check valve device constitutes an adapter that can be integrated into an existing fuel injection system without modification to existing components. The adapter and the check valve device can be mounted in a housing of the high-pressure pump, in a line between the high-pressure pump and the high-pressure fuel accumulator, or at an inlet of the high-pressure fuel accumulator. But the adaptor and the check valve device can also be provided at an outlet of the high-pressure fuel accumulator or in a high-pressure line between the high-pressure fuel accumulator and one of the injectors.

In another preferred exemplary embodiment of the fuel injection system, the check valve includes an adaptor housing with a high-pressure through hole, which has an enlarged section containing a valve bushing at the end of the adapter housing. The valve bushing preferably has a high-pressure through hole that is situated in an extension of the high-pressure through hole provided in the adapter housing. At one end of the high-pressure through hole is a high-pressure connection, for example for the high-pressure pump or the high-pressure fuel accumulator. At the other end of the high-pressure through hole is another high-pressure connection, for example for the high-pressure fuel accumulator or an injector.

In another preferred exemplary embodiment of the fuel injection system, the valve bushing has a blind hole containing a valve spring that presses a valve ball against one end of a low-pressure through hole whose other end has a low-pressure connection. The design and dimensions of the low-pressure through hole and the valve ball are matched so that the valve ball closes the low-pressure through hole at one end when resting against it.

In another preferred exemplary embodiment of the fuel injection system, the valve bushing contains a connecting groove that connects the blind hole to the high-pressure through hole. If a negative pressure prevails in the high-pressure through hole, then the pressure in the low-pressure through hole causes the spring-loaded valve ball to lift away from the low-pressure through hole so that fuel can flow from the low-pressure region, through the low-pressure through hole and the connecting groove, and into the high-pressure through hole.

In another preferred exemplary embodiment of the fuel injection system, the valve bushing has a through hole extending in the radial direction, which is connected to the high-pressure through hole and contains a valve sleeve that has an opening to the low-pressure region and an opening to the high-pressure through hole. The two openings of the valve sleeve produce a connection between the low-pressure region and the high-pressure region.

In another preferred exemplary embodiment of the fuel injection system, a valve ball rests against the opening of the valve sleeve leading to the high-pressure through hole. The design and dimensions of the opening and the valve ball are matched so that the opening is closed when the valve ball is resting against it.

In another preferred exemplary embodiment of the fuel injection system, a valve spring holds the valve ball against the opening of the valve sleeve leading to the high-pressure through hole. If negative pressure prevails in the high-pressure through hole, then the pressure in the low-pressure region causes the valve ball to lift away from the opening in opposition to the prestressing force of the valve spring so that fuel can flow out of the low-pressure region into the high-pressure region.

In another preferred exemplary embodiment of the fuel injection system, the valve spring and the valve ball are contained in an extended section of the valve sleeve that protrudes into the high-pressure through hole and is open to the high-pressure through hole. This simplifies installation of the check valve device. The valve spring and the valve ball can be preassembled in the valve sleeve. Then the preassembled valve sleeve is simply press-fitted into the valve bushing.

In another preferred exemplary embodiment of the fuel injection system, the check valve device is integrated into an additional connection to the high-pressure fuel accumulator. The additional connection produces a communication with the low-pressure region.

In another preferred exemplary embodiment of the fuel injection system, the low-pressure connection of the check valve device communicates with a return from the injectors. This makes it possible to reduce the line length.

BRIEF DESCRIPTION OF THE DRAWINGS

Other advantages, defining characteristics, and details of the present invention ensue from the description contained herein below, taken in conjunction with the drawings, in which.

DESCRIPTION OF THE PREFERRED EMBODIMENTS

Figure 1:
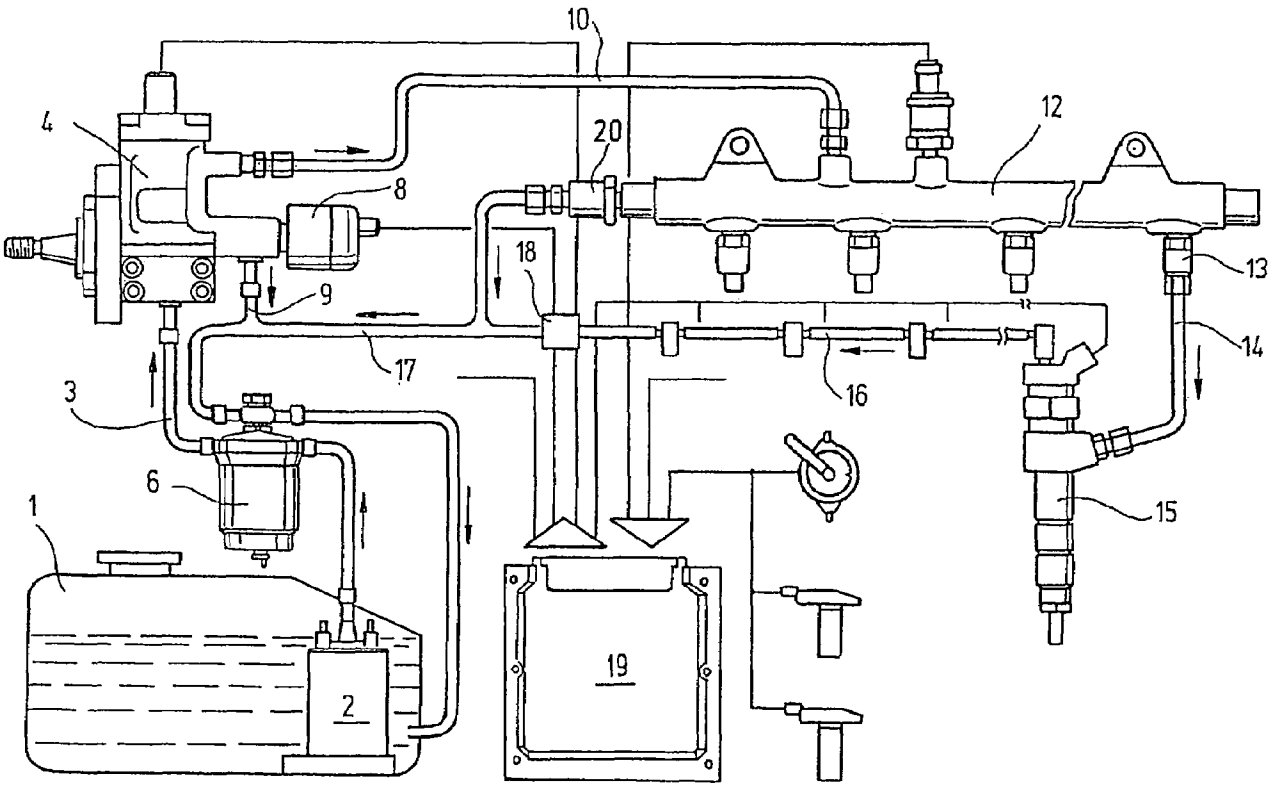
FIG. 1 is a schematic depiction of a known fuel injection system with which the invention may be used.

FIG. 1 schematically depicts a conventional common rail fuel injection system. From a low-pressure reservoir 1, which is also referred to as the fuel tank, a fuel supply pump 2 delivers fuel to a high-pressure pump 4 via a connecting line 3. The connecting line 3 contains an overflow valve 6. The low-pressure reservoir 1, the fuel supply pump 2, and the connecting line 3 are acted on with low pressure and are therefore referred to as the low-pressure region.

The high-pressure pump 4 is connected to a pressure control valve 8, which is connected to the low-pressure reservoir 1 via a line 9. In addition, a high-pressure line 10 leads from the high-pressure pump 4 and supplies the highly pressurized fuel to a high-pressure fuel accumulator 12, which is also referred to as a common rail. High-pressure lines 14 lead from the high-pressure accumulator 12 via interposed flow limiters 13 and deliver the highly pressurized fuel from the high-pressure accumulator 12 to injection valves 15, which are also referred to as injectors, only one of which is depicted in FIG. 1 for the sake of clarity. The high-pressure line 10, the high-pressure accumulator 12, the high-pressure line 14, and the injection valve 15 contain highly pressurized fuel and are therefore associated with the high-pressure region of the fuel injection system.

A return line, which includes two sections 16 and 17, leads from the fuel injection valve 15 to the low-pressure reservoir 1. A pressure-holding valve 18 is connected between the two sections 16 and 17 of the return line. The pressure-holding valve 18 is used to maintain a minimum pressure of approximately 10 bar in the section 16 of the return line, which permits a filling of a coupling chamber between the piezoelectric actuator and a control valve element in the fuel injection valve 15 regardless of the operating state of the fuel injection system. An electronic control unit 19 controls the operation of the fuel injection system. The high-pressure fuel accumulator 12 is provided with a pressure relief valve 20 that communicates with the return line. If the pressure in the high-pressure fuel accumulator 12 exceeds a predetermined maximum value, then the pressure relief valve 20 opens and the excess pressure in the high-pressure fuel accumulator 12 is discharged into the low-pressure region.

In the common rail system shown in FIG. 1, injectors can be used that have no leakage due to their structural design. As a result, the system is absolutely fluid-tight when not in operation. If there is a large temperature difference between when the engine is switched off and when it is restarted, then the fluid-tightness of the high-pressure region and the contraction of the fuel volume contained therein causes the air dissolved in the fuel to outgas. The outgassed air causes an unacceptable starting time delay during restarting.

In order to avoid an occurrence of negative pressure in the high-pressure system, which is accompanied by an undesirable starting delay, according to the present invention, a definite connection is produced between the high-pressure region and the low-pressure region without impairing the system efficiency due to leakage during operation.

According to the present invention, a check valve device is used to produce a definite connection between the high-pressure region and the low-pressure region. The check valve device assures that when the system is cooling down, for example when the system is not in operation, a connection is opened between the low-pressure region and the high-pressure region through which fuel can flow from the low-pressure region into the high-pressure region.

Figure 2:
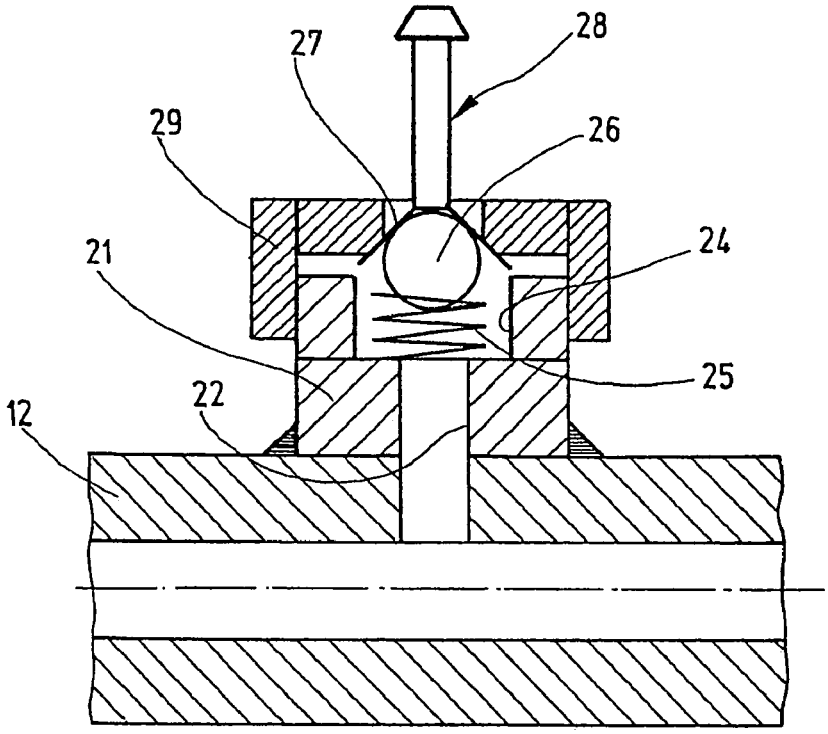
FIG. 2 is a schematic section through a check valve device according to a first exemplary embodiment.

FIG. 2 shows a schematic section through an exemplary embodiment of a check valve device according to the present invention. The high-pressure fuel accumulator 12 has an additional connection fitting 21 welded to it. The connection fitting 21 has a through hole 22 that feeds into the high-pressure fuel accumulator 12 and, toward the outside, transitions into a cylindrical countersink 24. The cylindrical countersink 24 contains a valve spring 25, which is prestressed against a valve ball 26. The valve spring 25 keeps the valve ball 26 in sealed contact with a funnel-shaped opening 27 of a connecting piece 28. The connecting piece 28 is connected to a low-pressure connecting line (not shown).

The connecting piece 28 is mounted onto the connection fitting 21 with the aid of a union nut 29. During normal operation of the fuel injection system, the valve ball 26 rests against the funnel-shaped opening 27 so that no highly pressurized fuel escapes from the high-pressure fuel accumulator 12 and into the low-pressure region via the connecting piece 28. If a negative pressure is generated in the high-pressure fuel accumulator 12, then the valve ball 26 lifts away from the funnel-shaped opening 27 so that fuel flows out of the low-pressure region, through the connecting piece 28 and the through hole 22, and into the high-pressure fuel accumulator 12. The connecting piece 28 is preferably connected to the return from the injectors.

Figure 3:
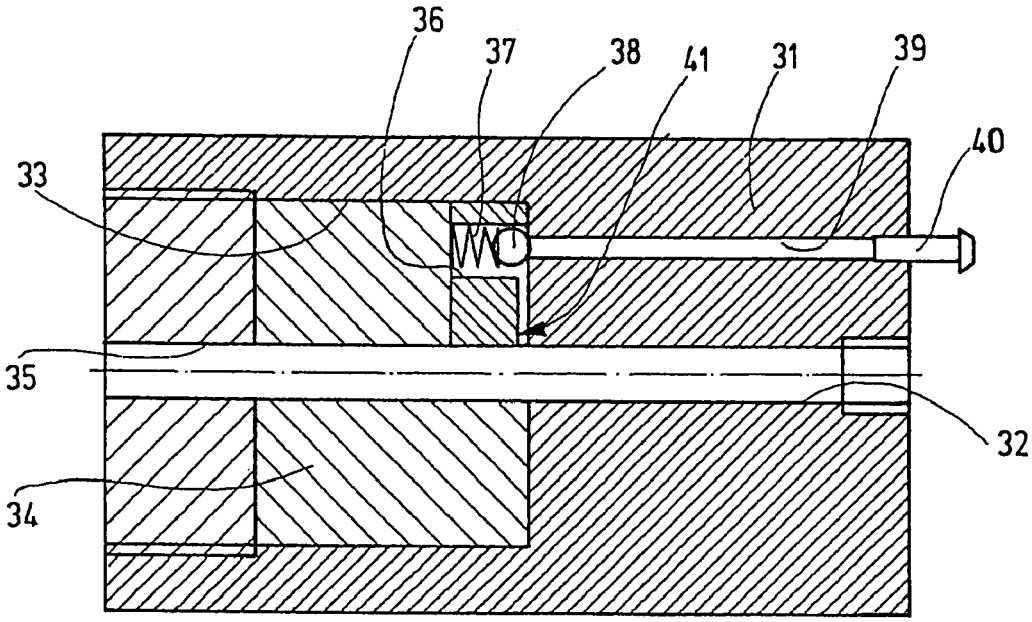
FIG. 3 is a schematic section through a check valve device according to a second exemplary embodiment.

FIG. 3 shows a check valve device according to a second exemplary embodiment of the present invention. The check valve device is accommodated in an adapter housing 31, which is essentially embodied in the form of a circular cylinder. The adapter housing 31 is provided with a central high-pressure through hole, through which, as indicated by arrows, highly pressurized fuel is conveyed from a high-pressure inlet to a high-pressure outlet. The high-pressure inlet is connected, for example, to the high-pressure pump or to the high-pressure fuel accumulator. The high-pressure outlet is connected, for example, to the high-pressure fuel accumulator or an injector.

At one end, the central high-pressure through hole 32 transitions into an enlarged section 33 into which a valve bushing 34 is press-fitted or screwed. The valve bushing 34 has a central high-pressure through hole 35 that is situated in the extension of the high-pressure through hole 32. A blind hole 36 that accommodates a valve spring 37 and a valve ball 38 is let into the end surface of the valve bushing 34 contained in the adapter housing 31. The valve spring 37 is prestressed against the valve ball 38 so that it holds the valve ball 38 against one end of a low-pressure through hole 39, which extends through the adapter housing 31 in the axial direction, parallel to the high-pressure through hole 32. The end of the low-pressure through hole 39 oriented away from the valve ball 38 is provided with a low-pressure connection 40. The blind hole 36 in the valve bushing 34 communicates with the high-pressure through hole 32 via a radially extending valve groove 41 that is let into the valve bushing 34.

During normal operation of the fuel injection system, a higher pressure prevails in the high-pressure through hole 32 than in the low-pressure through hole 39. Due to the pressure difference and the prestressing force of the valve spring 37, the valve ball 38 is kept in contact with the inner end of the low-pressure through hole 39 so that no highly pressurized fuel escapes from the high-pressure through hole 32 into the low-pressure through hole 39. If a temperature-induced negative pressure arises in the high-pressure through hole 32, then the valve ball 38 lifts away from the inner end of the low-pressure through hole 39 counter to the prestressing force of the valve spring 37 so that fuel can flow from the low-pressure region, through the low-pressure through hole 39 and the valve groove 41, and into the high-pressure through hole 32.

Figure 4:
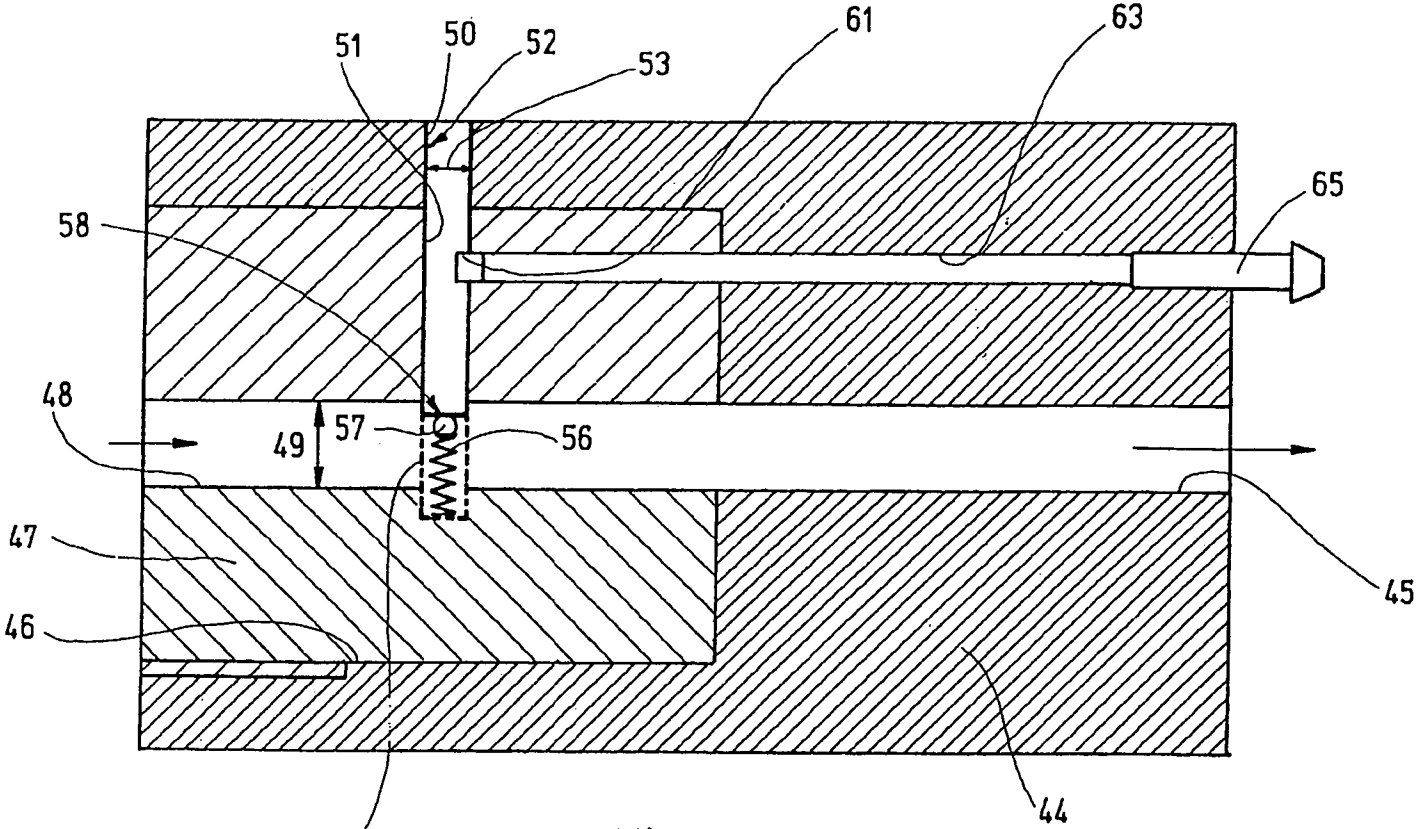
FIG. 4 is a schematic section through a check valve device according to a third exemplary embodiment.

FIG. 4 shows a section through another exemplary embodiment of the check valve device according to the present invention. The check valve device is accommodated in an essentially circular cylindrical adapter housing 44. The adapter housing 44 has a central high-pressure through hole 45, each of whose ends is provided with a high-pressure connection. Like the adapter housing 31 shown in FIG. 3, the adapter housing 44 can be attached to the housing of a high-pressure pump, in a line between the high-pressure pump and the high-pressure fuel accumulator, or at the inlet of the high-pressure fuel accumulator. With an appropriate adaptation of the line length, the adapter housing can also be accommodated in a high-pressure line.

At one end, the central high-pressure through hole 45 transitions into an enlarged section 46 into which a valve bushing 47 is press-fitted or screwed. The valve bushing 47 has a central high-pressure through hole 48 that is situated in the extension of the high-pressure through hole 45. The diameter 49 of the central high-pressure through hole 48 is precisely the same size as the diameter of the central high-pressure through hole 45. In addition, a radial through hole 51 is provided in the valve bushing 47, extending from the central high-pressure through hole 48 and aligned with a radial through hole 50 in the adapter housing 44.

The radial through hole 51 has a valve sleeve 52 press-fitted into it, which is embodied essentially in the form of a tubular circular cylindrical member that is closed at its ends. One end of the valve sleeve 52 is flush with the outer circumference surface of the adapter housing 44. The other end of the valve sleeve 52 protrudes into the central high-pressure through hole 48. The valve sleeve 52 has an inner diameter 53 that is significantly smaller than the inner diameter 49 of the high-pressure through hole 48.

An extended section 55, which is perforated, is attached to the end of the valve sleeve 52 protruding into the high-pressure through hole 48. The extended section 55 of the valve sleeve 52 contains a valve ball 57 and a valve spring 56. The prestressed valve spring 56 holds the valve ball 57 in contact with an opening 58 in the inner end of valve sleeve 52. The valve sleeve 52 also has an opening 61 that produces a connection between the inside of the valve sleeve 52 and a low-pressure through hole 63, which extends through the valve bushing 47 and the adapter housing 44 in the axial direction, parallel to the high-pressure through hole 45. A low-pressure connection 65 is provided at the outer end of the low-pressure through hole 63.

During normal operation of the fuel injection system, a higher pressure prevails in the high-pressure through hole 45 than in the low-pressure through hole 63. The pressure difference and the prestressing force of the valve spring 56 keep the valve ball 57 in contact with the opening 58 of the valve sleeve 52 so that there is no connection between the high-pressure region and the low-pressure region. If a negative pressure prevails in the high-pressure through hole 45, then the valve ball 57 lifts away from the opening 58 so that fuel can flow from the low-pressure region, through the low-pressure through hole 63 and the valve sleeve 52, and into the high-pressure through hole 45.

The foregoing relates to a preferred exemplary embodiment of the invention, it being understood that other variants and embodiments thereof are possible within the spirit and scope of the invention, the latter being defined by the appended claims.

The invention claimed is:

1. In a common rail fuel injection system having a low-pressure region from which a high-pressure fuel pump acts on fuel with high pressure and delivers it to a high-pressure fuel accumulator from which fuel is supplied to injectors that inject the highly pressurized fuel into the combustion chamber of an internal combustion engine in which the high-pressure pump, the high-pressure fuel accumulator, and the injectors are associated with a high-pressure region, the improvement comprising a check valve device connected between the low-pressure region and the high-pressure region, whereby when a negative pressure is generated in the high-pressure region, fuel flows from the low-pressure region into the high-pressure region, wherein the check valve comprises an adapter housing equipped with a high-pressure through hole having an enlarged section situated at one end of the adapter housing and containing a valve bushing.

2. The fuel injection system according to claim 1, wherein the check valve device comprises a high-pressure inlet, a high-pressure outlet, and a low-pressure connection.

3. The fuel injection system according to claim 1, wherein the valve bushing comprises a blind hole, a valve spring and a valve ball contained in the blind hole, the valve spring pressing the valve ball against one end of a low-pressure through hole provided in the adapter housing, the other end of the through hole being equipped with the low-pressure connection.

4. The fuel injection system according to claim 3, further comprising a connecting groove let into the valve bushing and connecting the blind hole to the high-pressure through hole.

5. The fuel injection system according to claim 1, wherein the valve bushing comprises a through hole extending in the radial direction and communicating with the high-pressure through hole, a valve sleeve contained in the radial through hole, the valve sleeve having an opening leading into the low-pressure region and an opening leading into the high-pressure through hole.

6. The fuel injection system according to claim 5, further comprising a valve ball resting against the opening of the valve sleeve leading into the high-pressure through hole.

7. The fuel injection system according to claim 6, further comprising a valve spring keeping the valve ball in contact with the opening of the valve sleeve leading into the high-pressure through hole.

8. The fuel injection system according to claim 7, wherein the valve spring and the valve ball are contained in an extended section of the valve sleeve protruding into the high-pressure through hole, which extended section is open to the high-pressure through hole.

9. The fuel injection system according to claim 1, wherein the check valve device is integrated into an additional connection to the high-pressure fuel accumulator.

10. The fuel injection system according to claim 2, wherein the low-pressure connection communicates with a return from the injectors.

11. The fuel injection system according to claim 3, wherein the low-pressure connection communicates with a return from the injectors.

12. The fuel injection system according to claim 4, wherein the low-pressure connection communicates with a return from the injectors.

13. The fuel injection system according to claim 5, wherein the low-pressure connection communicates with a return from the injectors.

14. The fuel injection system according to claim 6, wherein the low-pressure connection communicates with a return from the injectors.

15. The fuel injection system according to claim 7, wherein the low-pressure connection communicates with a return from the injectors.

16. The fuel injection system according to claim 8, wherein the low-pressure connection communicates with a return from the injectors.

17. The fuel injection system according to claim 9, wherein the low-pressure connection communicates with a return from the injectors.

* * * * *